US005143124A

United States Patent [19]

Froment

[11] Patent Number: 5,143,124

[45] Date of Patent: Sep. 1, 1992

[54] CABLE WEAR PAD FOR DOBBY SHEDDING LEVER

[75] Inventor: Jean-Paul Froment, Faverges, France

[73] Assignee: S. A. Des Etablissements Staubli (France), Faverges, France

[21] Appl. No.: 687,758

[22] Filed: Apr. 19, 1991

[30] Foreign Application Priority Data

May 16, 1990 [FR] France ..... 90 06336

[51] Int. Cl.[5] ..... D03C 1/14

[52] U.S. Cl. ..... 139/88; 139/82; 403/157; 474/177

[58] Field of Search ..... 24/115 A; 403/43, 157, 403/161, 163; 139/66 R, 87, 66 A, 71, 82, 88; 254/374, DIG. 14; 242/117; 474/177, 178

[56] References Cited

U.S. PATENT DOCUMENTS

| | | | |
|---|---|---|---|
| 4,386,631 | 6/1983 | Mizoguchi | 139/71 |
| 4,571,225 | 2/1986 | Lengenfelder, Jr. et al. | 474/177 X |
| 4,822,197 | 4/1989 | De Martino et al. | 403/157 X |
| 4,957,142 | 9/1990 | Houlon | 139/88 |

FOREIGN PATENT DOCUMENTS

| | | | |
|---|---|---|---|
| 274971 | 7/1988 | European Pat. Off. | 139/66 R |
| 2499106 | 1/1981 | France . | |

*Primary Examiner*—Andrew M. Falk
*Attorney, Agent, or Firm*—Dowell & Dowell

[57] ABSTRACT

A system for fastening the drawing cables on the suspension levers of textile dobbies of the negative type, wherein the levers include flanges to which mounting eyes connected to the cables are secured. The cables are guided in grooves formed in a bearing pad which is cooperatively seated against the outer edge of the levers.

7 Claims, 5 Drawing Sheets

Fig. 1
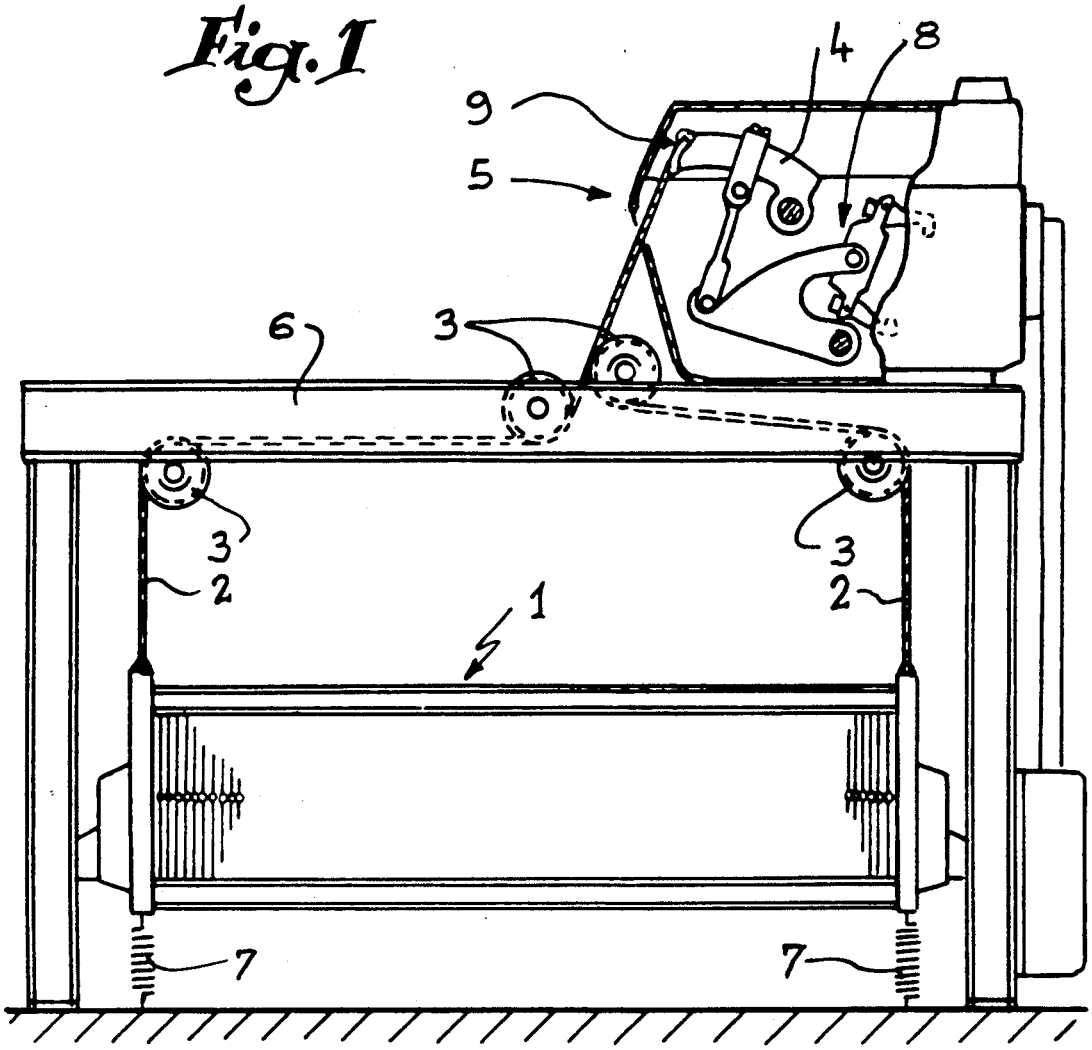
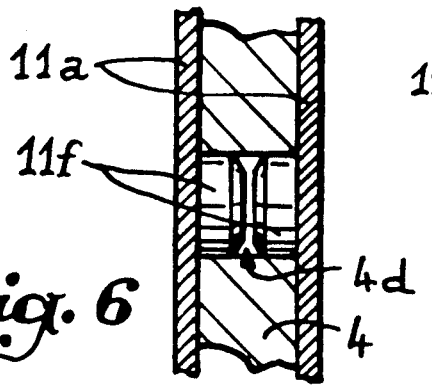
Fig. 6
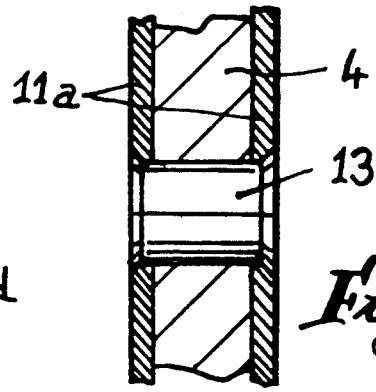
Fig. 7

Fig. 4
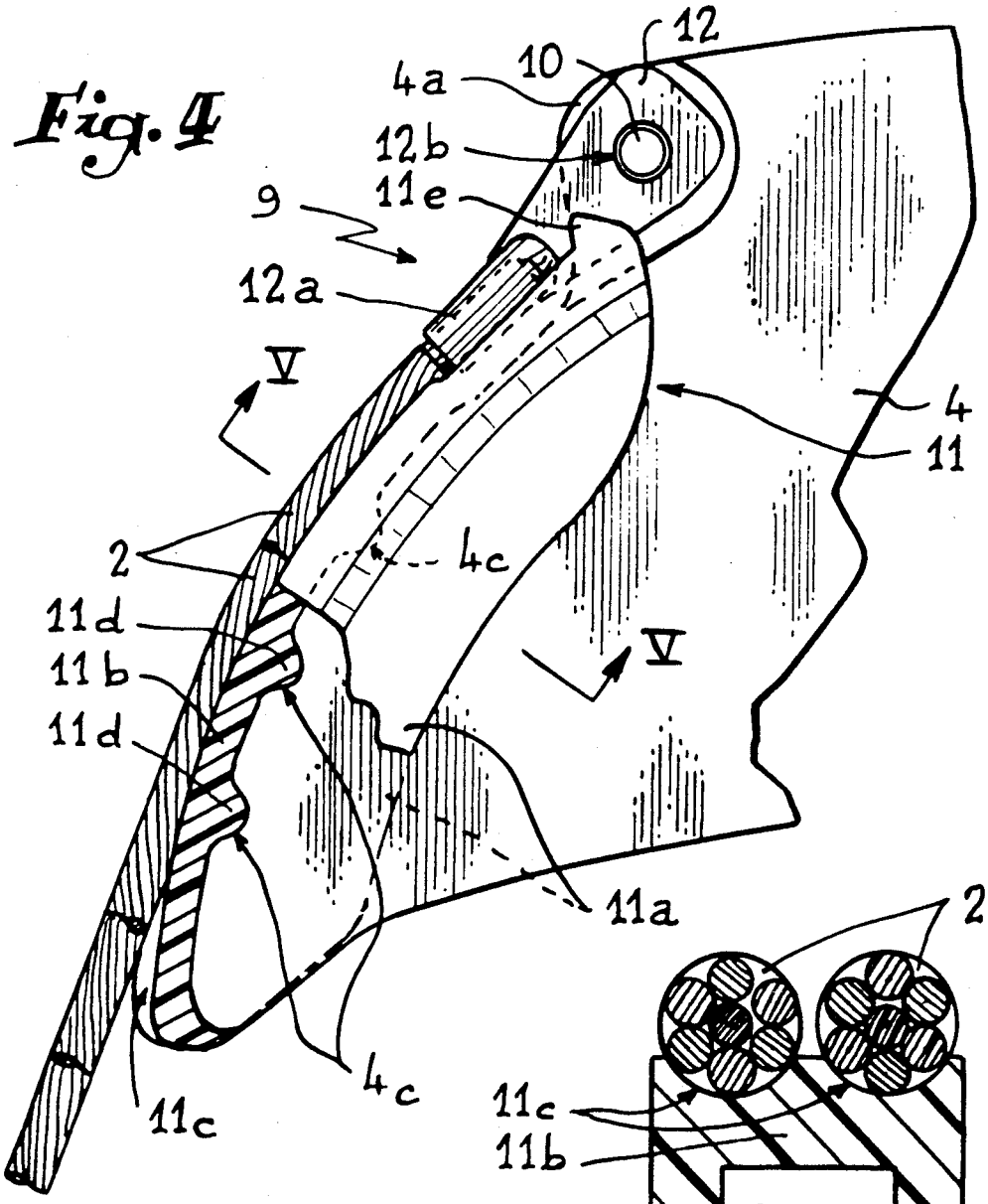
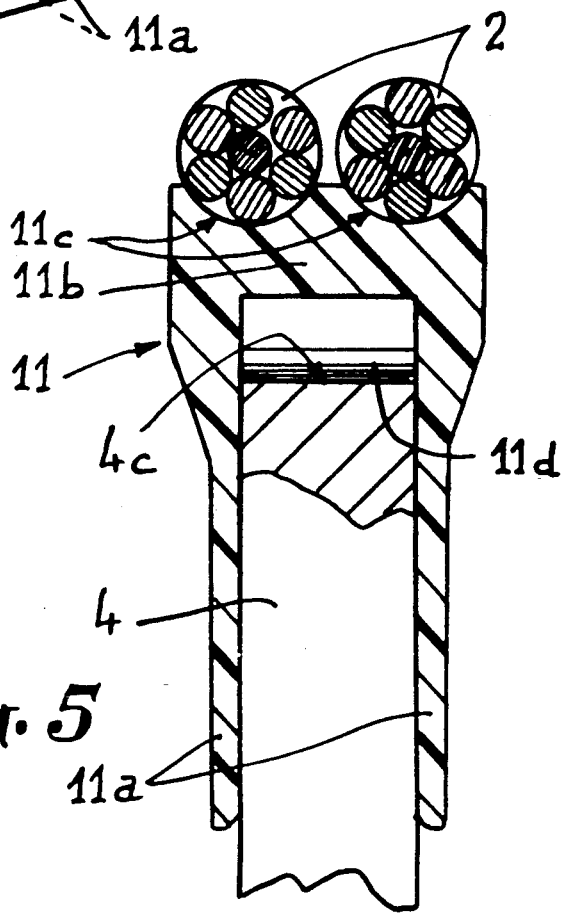
Fig. 5

CABLE WEAR PAD FOR DOBBY SHEDDING LEVER

BACKGROUND OF THE INVENTION

1. Field of the Invention

The present invention relates to dobbies of the negative type for forming the shed in weaving looms, and more particularly to the fastening of the drawing cables on the suspension levers associated with the heddle frames.

2. History of the Related Art

Such fastening, in fact, raises relatively difficult problems, since it involves securing the ends of two cables of appreciable diameter on a piece whose width is necessarily narrow, while the forces exerted on the cables are extremely high. Among the different solutions proposed, mention may be made of the one disclosed in French Patent No. 2 499 106 to STAUBLI, relating to a clip having two parallel side plates supporting a pin for the articulation of an assembly at the end of a suspension lever. The side plates comprise, in addition to a curved lower guide, an upper stop provided with two forks traversed by threaded end pieces secured to the cables and forming bearings for nuts.

Although such a clip allows the tension of the cables to be adjusted, this is nonetheless only possible at the detriment of the weight of the assembly. The pivot pin wears out quickly and the continual pivoting of the assembly imparts detrimental vibratory effects to the drawing cables.

SUMMARY OF THE INVENTION

It is an object of the present invention to overcome the problems set forth hereinabove by providing a system for fastening the drawing cables on the suspension levers of textile dobbies of the negative type, wherein the system comprises, in combination:

on the one hand, on the outer edge of each lever, a longitudinal rib or flange adapted to ensure the fastening of at least one eye crimped at the end of at least one drawing cable, on the other hand, a bearing pad of U cross-section adapted to lap over the edge of the lever against which it is appropriately retained, which pad includes on its outwardly turned face at least one longitudinal groove adapted to form a guide for the cable.

BRIEF DESCRIPTION OF THE DRAWINGS

The invention will be more readily understood on reading the following description with reference to the accompanying drawings, in which:

FIG. 1 is a schematic view illustrating a dobby of negative type of which suspension levers are equipped with fastening elements according to the invention.

FIG. 4 is a side view with parts longitudinally broken away.

FIG. 5 is a transverse section along plane V—V of FIG. 4.

FIGS. 6 and 7 illustrate in section two embodiments for retaining the bearing pad against the outer edge of the suspension lever.

DETAILED DESCRIPTION OF THE DRAWINGS

Figure 2:
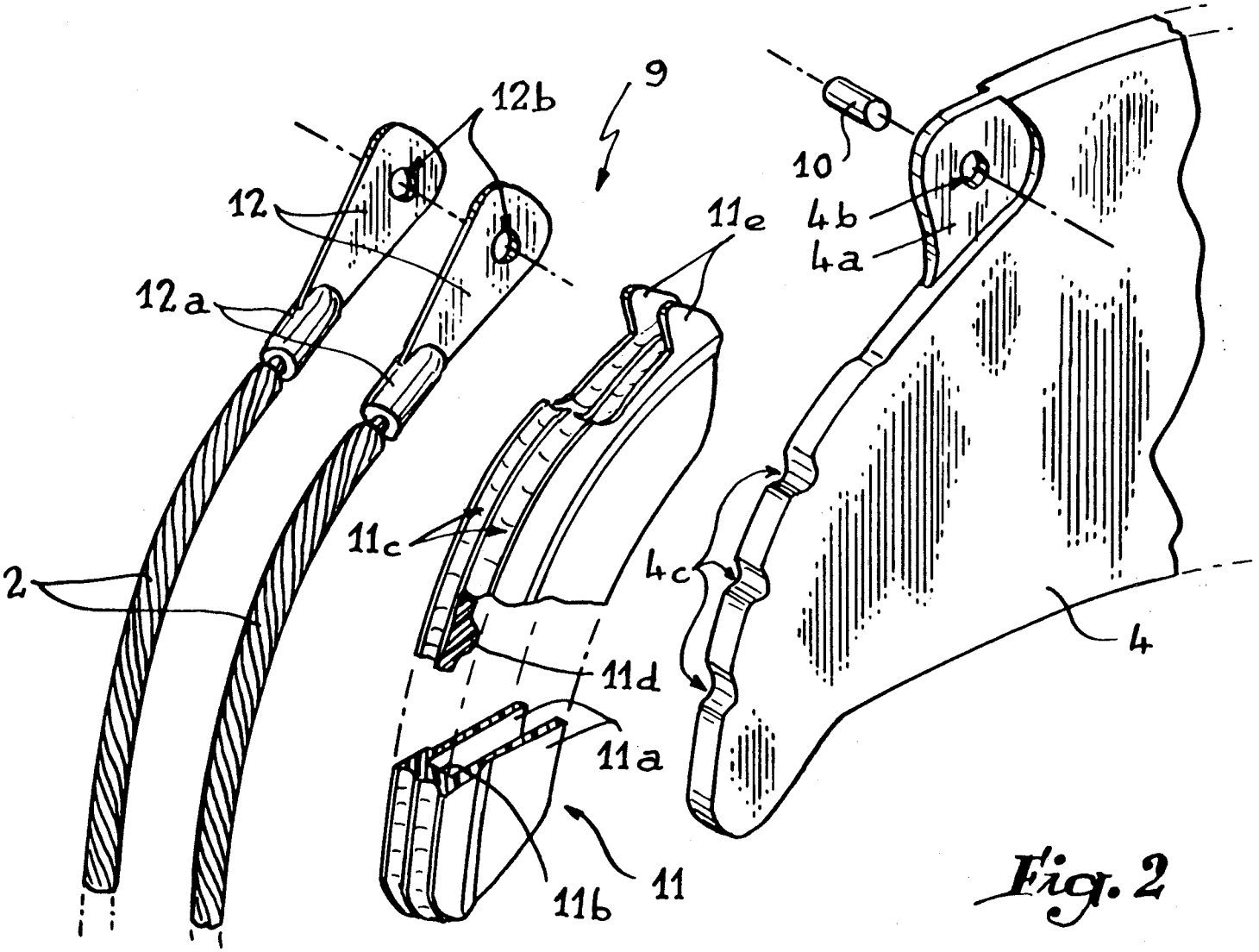
FIG. 2 shows the different fastening elements of one embodiment of the present invention prior to the assembly thereof.
Figure 3:
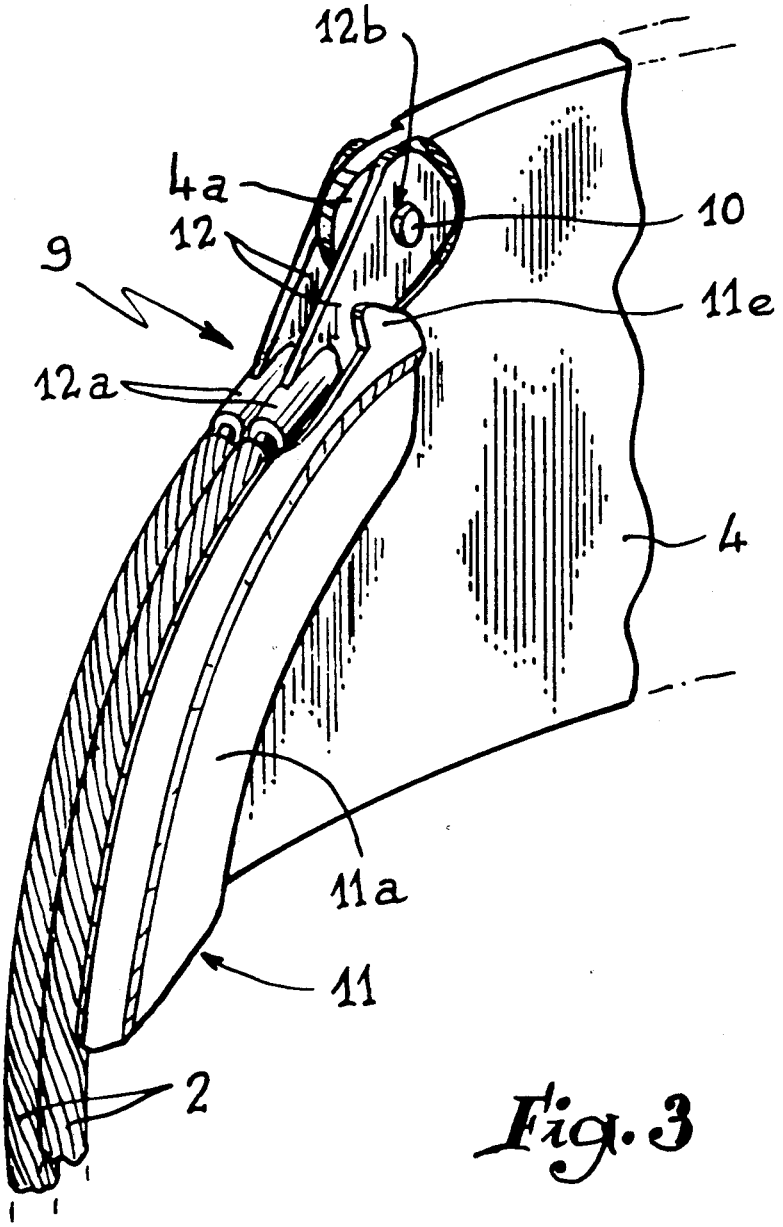
FIG. 3 reproduces FIG. 2 after the elements have been assembled and positioned.

Referring now to the drawings, reference 1 in FIG. 1 designates one of the heddle frames mounted on a weaving loom. Each frame 1 is moved vertically by two drawing cables 2 which are guided by pulleys 3 to be fastened to one of the suspension levers 4 of the dobby 5 installed on an upper structure 6 of the loom. In the present case, this is a negative dobby in which each suspension lever 4 is actuated, against the reaction forces exerted on each frame 1 by return springs 7, by a mechanism 8 of the double-swinging lever type.

The system 9 for fastening the two cables 2 on the free end of the lever 4 has been shown in detail in FIGS. 2 to 5.

This system firstly includes, at the level of the outer edge of the lever 4, a rib or flange 4*a*, which in the embodiment in thin, which rib is oriented longitudinally and has an opening 4*b* therebetween. In this opening 4*b* is introduced a small pin which is retained axially by crimping, by engagement by friction force or by welding. It will be observed that, below the flange 4*a*, the edge of the lever 4 presents a curved profile and comprises a series of depressions 4*c*, three in number in the embodiment shown.

The fastening system also includes a bearing pad 11, advantageously made of molded synthetic material. As shown more particularly in FIG. 5, this pad 11 has a downwardly open U-section, defining two lateral flanges 11*a* joined at their upper ends by a central web 11*b*. The outer surface of the web 11*b* has two longitudinal grooves 11*c* hollowed out therein, while the opposite face, disposed between the flanges 11*a*, includes three bosses or projecting ribs 11*d*. Of course, the pad 11 presents a profile complementary of that of the outer edge of the lever 4, in order to abut thereagainst, in the manner which will be described hereinbelow.

The system according to the invention is completed by two flattened eyes 12 of which each is provided with a cylindrical end piece 12*a* adapted to be crimped at the end of one of the two drawing cables 2. As shown in FIG. 2, each eye 12 includes a hole 12*b* to allow it to be fastened on pin 10.

It is readily appreciated that pad 11 is capable of being mounted on the outer edge of the lever 4 shown, the parts in relief formed by bosses 11*d* cooperating with the depressions or recesses 4*c* of the outer edge. Pin 10 having been assumed to be positioned in opening 4*b* of the flange 4*a*, it suffices to introduce each eye 12 on the pin via its hole 12*b*.

In operation the force exerted on cables 2 maintains the cables in the grooves 11*c* of pad 11, which is thus firmly retained in place by interpenetration of ribs lid into depressions 4*c*. It should be observed that the upper end of pad 11 is provided with two lateral protrusions 11*e* which are positioned and profiled to be disposed slightly below pin 10, consequently ensuring that the eyes 12 are retained on the pin.

The cables 2 are consequently perfectly fastened on the lever 4, despite the forces which are exerted thereon. The grooves 11*c* ensure guiding of the cables, opposing any vibratory effect. Pad 11 requires no separate member to be secured to the suspension lever, and no precision-machining is necessary on the lever.

It goes without saying that any suitable system may be employed for retaining the bearing pad 11 against the outer edge of the lever 4. In FIG. 6, it has been assumed that the inner face of each of the flanges 11*a* of the pad included at least one lateral boss 11*f* adapted to snap into a corresponding perforation 4*d* in the lever 4. Although such a system involves an independent fixing operation, the embodiment illustrated in FIG. 7 may be employed, making use of rivets 13 which traverse perforations made in the flanges 11*a* and in the lever 4.

It should furthermore be observed that, although the invention is particularly advantageous in the case described hereinabove where two drawing cables are associated with each suspension lever, it is nonetheless applicable to dobbies in which each suspension lever 4' ensures movement of a heddle frame 1 with the aid of one cable 2.

Figure 8:
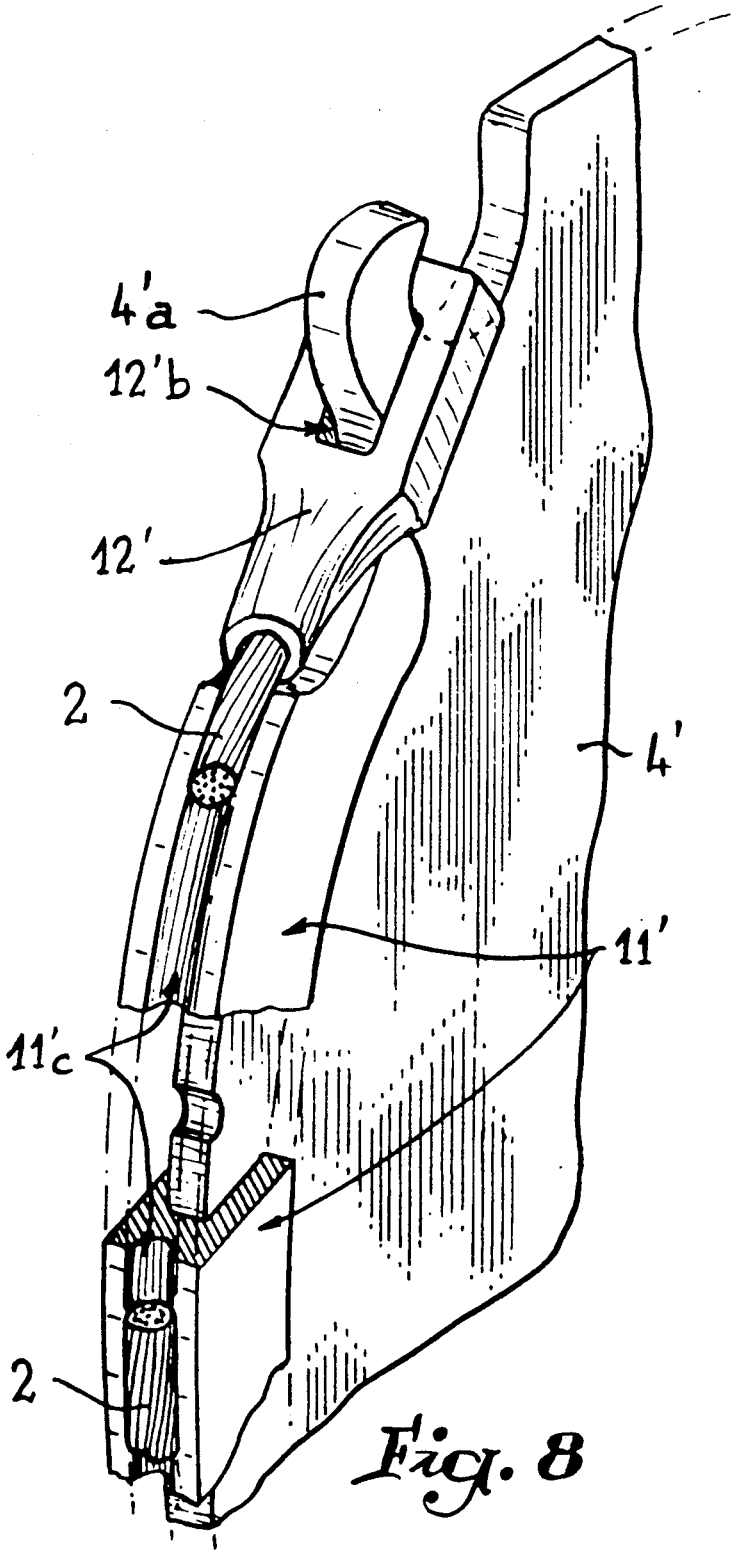
FIG. 8 shows the application of the invention to a suspension lever associated with a single drawing cable.

In such a case and as illustrated in FIG. 8, the rib or flange 4'*a* may be sectioned as a hook and penetrate in the opening 12'*b* of a closed eye 12' crimped at the end of cable 2. Of course, the bearing pad 11' comprises only one longitudinal groove or guide 11'*c*.

What is claimed is:

1. A system for fastening the end of at least one drawing cable to a suspension lever of a textile dobby of the negative type wherein the lever includes an outer edge, the system comprising, the drawing cable having a mounting eye secured to the end thereof, a flange on the outer edge of the lever, fastening means for securing said mounting eye to said flange, a bearing pad of U-shaped cross section adapted to be seated over the outer edge of the lever, said bearing pad and the outer edge of the lever, said bearing pad and the outer edge of the lever including complementary mating surface portions adapted to oppose any relative sliding between the lever and said bearing pad, said complementary mating surface portions including a plurality of projecting ribs on said bearing pad which are cooperatively seated within a plurality of spaced depressions in the outer edge of the lever, said bearing pad including an outer face, and at least one groove in said outer face forming a guide for the at least one cable.

2. A system for fastening the end of two drawing cables to a suspension lever of a textile dobby of the negative type wherein the lever includes an outer edge, the system comprising, each drawing cable having a mounting eye secured to the end thereof, a flange on the outer edge of the lever, fastening means for securing said mounting eye of each cable to said flange, a bearing pad of U-shaped cross section adapted to be seated over the outer edge of the lever, said bearing pad including an outer face, a pair of grooves in said outer face forming guides for the two drawing cables, said flange of the lever having an opening therethrough, a fastening pin mounted within said opening and extending outwardly on opposite sides of said flange, and said drawing cables being mounted on opposite sides of the lever with said mounting eyes thereof being supported by said fastening pin.

3. The system of claim 2 wherein said bearing pads include two outwardly extending protrusions which engage said mounting eyes on said opposite sides of said flange.

4. The system of claim 2 in which said bearing pad includes a pair of spaced flanges extending on opposite sides of the lever adjacent the outer edge, and fastening element means for securing said spaced flanges to the lever.

5. The system of claim 2 wherein said bearing pad and the outer edge of the lever include complementary mating surface portions adapted to oppose any relative sliding between the lever and said bearing pad.

6. The system of claim 5 in which complementary mating surface portions include a plurality of projecting ribs on said bearing pad which are cooperatively seated within a plurality of spaced depressions in the outer edge of the lever.

7. A system for fastening the end of at least one drawing cable to a suspension lever of a textile dobby of the negative type wherein the lever includes an outer edge, the system comprising, the drawing cable having a mounting eye secured to the end thereof, a flange on the outer edge of the lever, a hook formed with said flange for securing the mounting eye to said flange, a bearing pad of U-shaped cross section adapted to be seated over the outer edge of the lever, said bearing pad including an outer face, and at least one groove in said outer face forming a guide for the at least one cable.

* * * * *